United States Patent [19]

Bonfiglioli et al.

[11] Patent Number: 4,751,905

[45] Date of Patent: Jun. 21, 1988

[54] DEVICE FOR SUPPLYING A MIXTURE OF FUEL AND AIR TO A MANIFOLD OF AN INTERNAL COMBUSTION ENGINE

[75] Inventors: Silverio Bonfiglioli, Zola Predosa; Giovanni Gardellini, Casalecchio Di Reno; Claudio Zaccherini, Bologna, all of Italy

[73] Assignee: Weber S.p.A., Italy

[21] Appl. No.: 912,494

[22] Filed: Sep. 29, 1986

[30] Foreign Application Priority Data

Oct. 11, 1985 [IT] Italy ..... 67 861-A/85

[51] Int. Cl.[4] ..... F02M 51/02

[52] U.S. Cl. ..... 123/470; 123/472; 261/78.1; 261/DIG. 39; 261/DIG. 82

[58] Field of Search ..... 123/470, 472, 478; 261/DIG. 39, DIG. 82, 78.1

[56] References Cited

U.S. PATENT DOCUMENTS

| | | | |
|---|---|---|---|
| 408,460 | 8/1888 | Capitaine | 261/78.1 X |
| 2,364,987 | 12/1944 | Lee | 261/DIG. 39 X |
| 4,250,842 | 2/1981 | Sutton | 123/472 |
| 4,347,823 | 9/1982 | Kessler et al. | 261/DIG. 82 X |
| 4,416,241 | 11/1983 | Knapp et al. | 123/470 X |
| 4,595,542 | 6/1986 | Jones | 261/DIG. 82 X |

FOREIGN PATENT DOCUMENTS

| | | | |
|---|---|---|---|
| 204958 | 11/1983 | Japan | 123/470 |
| 74369 | 4/1984 | Japan | 123/470 |
| 2027488 | 2/1980 | United Kingdom | 261/DIG. 82 |
| 2090328 | 7/1982 | United Kingdom | 123/470 |
| 309542 | 7/1971 | U.S.S.R. | 123/510 |

*Primary Examiner*—Tony M. Argenbright
*Assistant Examiner*—Eric R. Carlberg
*Attorney, Agent, or Firm*—Andrus, Sceales, Starke & Sawall

[57] ABSTRACT

The device substantially comprises an upper body in which is formed a first perforation in communication with an air intake opening and delimited by a first conical surface and a support element for a fuel atomisation and metering valve having a tubular form and connected to the first conical surface by means of a pair of ribs disposed substantially in the plane which contains the axis of the first conical surface. The device further includes a lower body in which is formed a second perforation delimited by a second conical surface coaxial with the first and which is in communication with a mixture supply opening, the cone angle of the second conical surface being greater than that of the first conical surface.

11 Claims, 2 Drawing Sheets

DEVICE FOR SUPPLYING A MIXTURE OF FUEL AND AIR TO A MANIFOLD OF AN INTERNAL COMBUSTION ENGINE

BACKGROUND OF THE INVENTION

The present invention relates to a device for the supply of a mixture of air and fuel to the manifold of an internal combustion engine, of the type which includes an electromagnetically operated fuel atomisation and metering valve operable to deliver predetermined quantities of fuel in the form of atomised particles.

As is known, devices of this type normally include several parts within which are formed a duct which puts an air intake opening into communication with a mixture supply opening the flow cross section of which is controlled by a butterfly valve; the fuel atomisation and metering valve is able to deliver atomised fuel into the air which flows along the said duct in such a way as to form with this a mixture of air and atomised fuel.

Devices of the type described normally include a flange able to allow them to be fixed to an attachment plate of the manifold, and are normally provided with an air filter operable to filter the air which enters into the air intake of the device.

Devices of the type described have various disadvantages.

First of all, they are not able to prepare a perfectly homogeneous mixture of air and fuel in all operating conditions of the device; this is due to the fact that along the duct into which the atomised fuel is delivered, the path of the air is such as not always to give rise to sufficient vortex movements for homogeneous mixture with the fuel particles. Moreover, along the said duct, within which both the air and the mixture of air and fuel moves, there is the tendency for the formation of fuel droplets, with the disadvantage of producing an irregular operation of the engine when idling, and of dissipating part of the energy provided by the atomisation and metering valve in the step of atomisation of the fuel; in fact, the flow of atomised fuel which is delivered from the atomisation and metering valve can be perturbed by the flow of air and directed onto the surfaces of the duct and those of the butterfly valve, giving rise in this way to droplets of fuel on these surfaces; these, passing in a discontinuous manner through the mixture delivery outlet cause anomalous operation, particularly in slow running conditions.

In devices of the type described, during the movement of the air and mixture along the first mentioned duct, there are pressure losses due to the form of the duct itself and the high aerodynamic resistance which opposes the movement of the fluid and which is generated by parts and members of the device. Further the flow of mixture which leaves the first mentioned mixture delivery outlet can be non-uniform with the disadvantage of giving rise to irregularities in metering to the various cylinders; different distributions of the flow of mixture to the various cylinders is also encountered depending on whether a filter is mounted on the device or whether it has no filter.

Devices of the type indicated are structurally rather complex because of the numerous parts of which they are made and the manner in which the parts are connected together; moreover, they are rather cumbersome which makes it particularly difficult to replace a conventional carburetor with a device of the type described on an internal combustion engine.

Normally, devices of this type can be mounted directly on the plate of the manifold on which a traditional carburetor is mounted, but it is necessary to utilize suitable connector parts and members; for fixing the device to the said plate rather complicated connection members must be utilised, which therefore makes the said assembly and dismantling operations of the device itself from the first mentioned plate rather difficult.

Finally, because of the form of the air induction opening, filters of particular, and sometimes rather complex, form are required in the forward parts.

SUMMARY OF THE INVENTION

The object of the present invention is that of providing a device for supplying a mixture of air and fuel to a manifold of an internal combustion engine, of the type which has been briefly described above, which is free from the first mentioned disadvantages.

The said objects are obtained by means of a device for the supply of a mixture of air and fuel to a manifold of an internal combustion engine, comprising an electromagnetically operated fuel atomisation and metering valve operable to deliver predetermined quantities of fuel in the form of atomised particles which move substantially within a spray cone, the said valve being disposed along a duct which puts an air induction opening into communication with a mixture supply opening the flow cross section of which is controlled by a butterfly, the said device being fixable to an attachment plate of the said manifold and being able to receive an air filter of annular form for filtering air which enters the said induction opening, characterised by the fact that it includes an upper body in which is formed a first perforation in communication with the said air induction opening and delimited by a first conical surface, and a tubular valve-support element disposed within the said perforation, coaxial with the said first conical surface and connected to this latter by means of a pair of ribs disposed substantially in the plane which contains the axis of the said first conical surface, a lower body in which is formed a second perforation delimited by a second conical surface, coaxial with the first and which is in communication with the said mixture supply opening, the cone angle of the said second conical surface being greater than the cone angle of the said first conical surface.

BRIEF DESCRIPTION OF THE DRAWINGS

For a better understanding of the present invention a more detailed description of an embodiment is now given by way of example, with reference to the attached drawings, in which.

DETAILED DESCRIPTION OF THE INVENTION

Figure 3:
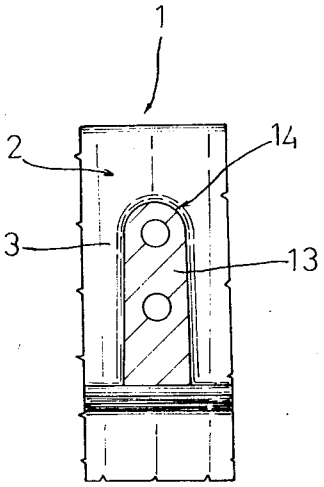
FIG. 3 is a detail of the device, corresponding to a section taken on the line III—III of FIG. 1.

The device of the invention comprises an upper body 1 having an approximately cylindrical outer form C in the interior of which is formed a cavity 2 delimited by a conical surface 3 converging towards the lower part of the body; conveniently the said surface constitutes the surface which internally delimits a conical wall 4 (FIG. 4) which constitutes the fundamental part of the body itself and from which radially project several radial enlargements 5.

The upper body 1 further includes a support element 6 of substantially tubular form operable to support a fuel atomisation and metering valve 7 of any known type; for this purpose within the said support element there is formed a corresponding seat 8 and the valve is fixed in it, for example, by means of an upper collar 9 and with the interposition of a washer 10 and a resilient ring 10*a* of suitable form.

Figure 1:
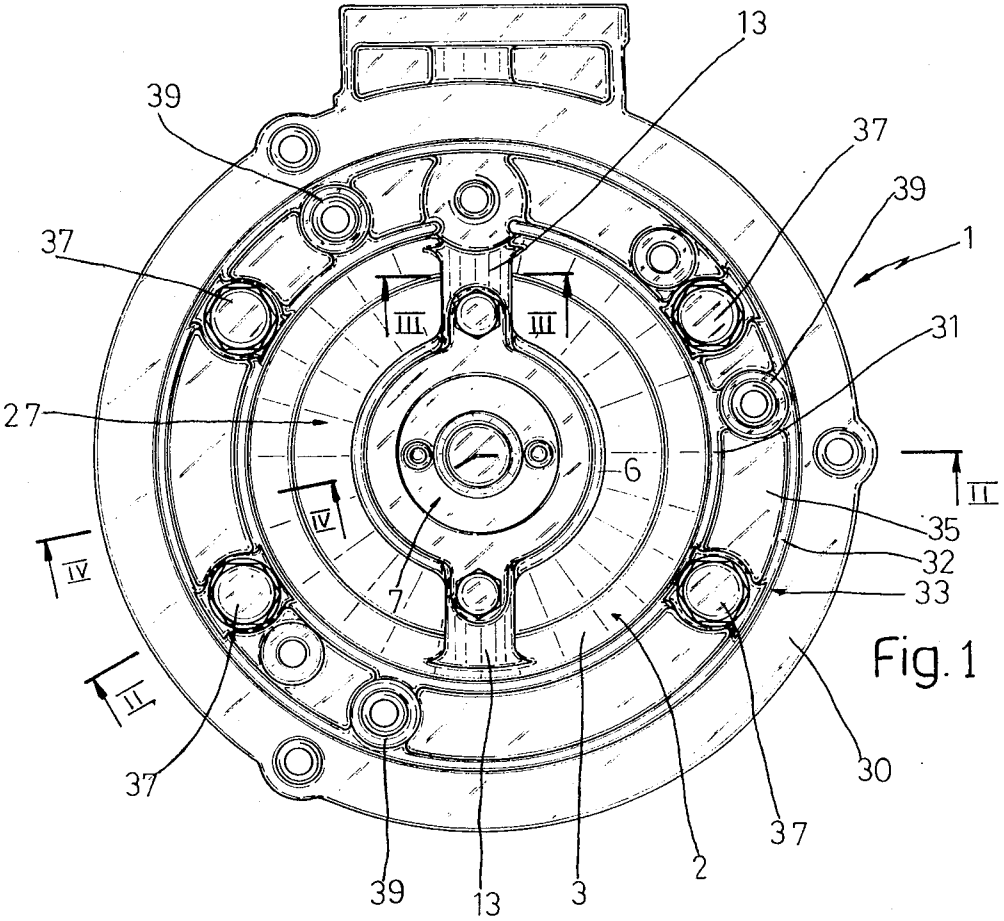
FIG. 1 is a plan view from above of the device of the invention.

The support element 6 is connected to the conical surface 3 by means of a pair of ribs 13 (FIG. 1 and FIG. 3) which, as is clearly seen in FIG. 1, are disposed substantially in the plane which contains the axis of the conical surface 3 and therefore the axis of the atomisation and metering valve 7. These ribs therefore project, as is clearly shown in FIG. 1, from diametrically opposite parts of the support element 6 and each has a substantially rectangular section (FIG. 3) and is delimited at the top by a cylindrical surface portion 14.

Figure 2:
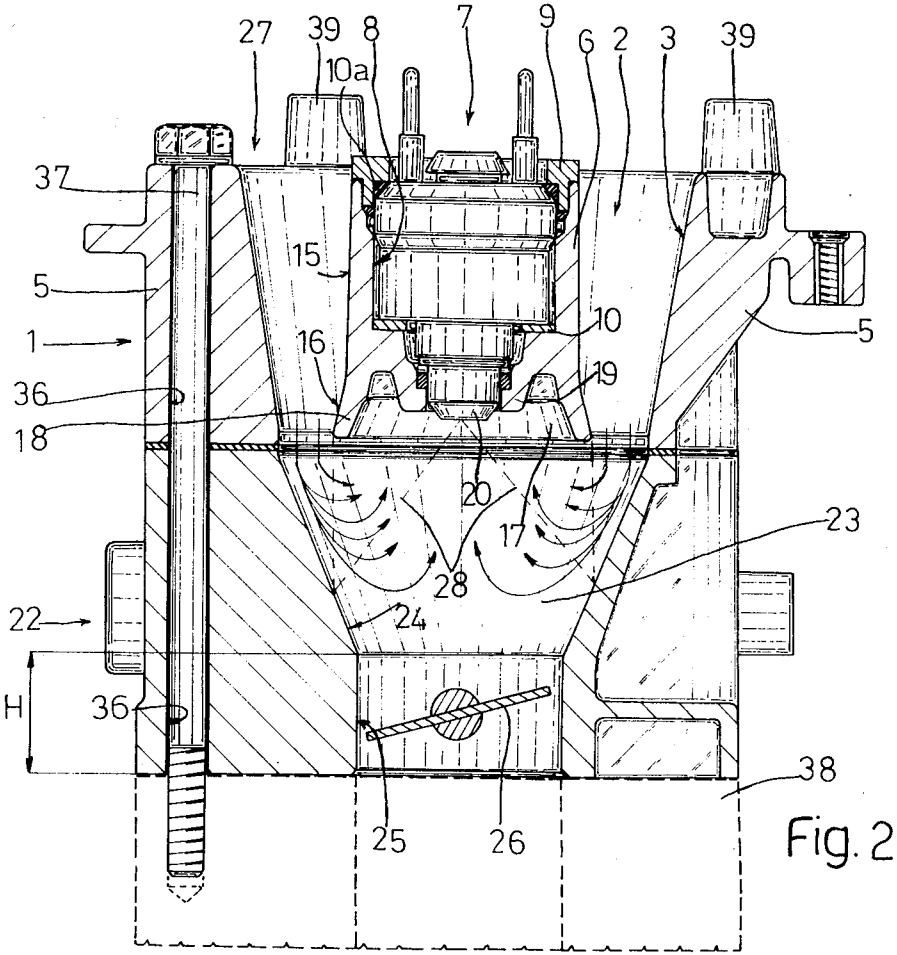
FIG. 2 is a section of the device of FIG. 1 taken on the line II—II.

As is clearly seen in FIG. 2, the support element 6 is externally delimited by a first substantially cylindrical surface portion 15 and by a second substantially conical surface portion 16, the height of which is much less than that of the cylindrical surface and which diverges towards the lower part of the body 1. In the support element 6, and substantially within the second conical surface portion 16, there is formed an annular cavity 17 which is defined between an annular projection 18 and a collar 19 from which projects the nozzle 20 of the valve 7.

The device further includes a lower body 22 in the interior of which is formed a cavity 23 delimited by a conical surface 24 which converges towards the lower part of the body; the cavity 23 is in communication with a mixture delivery outlet 25 the flow cross section of which is controlled by a butterfly 26. The height H of the opening is equal to or greater than its radius and the maximum diameter of the conical surface 24 is equal to the minimum diameter of the conical surface 3 in such a way as to form with this a single duct which puts the air intake opening 27 into communication with the said mixture delivery opening 25.

As is clearly seen in FIG. 2, the cone angle of the conical surface 24 is greater than that of the conical surface 3; moreover, the axial length of the support element 6 is substantially equal to the axial length of the perforation 2; the support element 6 then defines with the conical surface 3 a passage section from the first body 1 to the second body 22 the area of which is substantially greater than 50 percent of the area of the mixture supply opening 25.

The jet of atomised fuel which is delivered by the atomisation and metering valve 7 is disposed substantially in a cone, the angle of which has been indicated in FIG. 2 by means of a pair of generatrices 28 which belong to the outer conical surface which delimits the said cone.

Conveniently, the maximum diameter of the conical surface 16 which externally delimits the annular projection 18 of the support element 6 is chosen to be substantially equal to the diameter of the circumference which is obtained by intersecting the conical surface which delimits the said spray cone of atomised fuel with the conical surface 24 of the perforation 23 formed in the body 22. In FIG. 2 it has been supposed that these geometrical conditions were realised from which it follows that the entire spray cone is protected by the annular projection 18 in such a way as to prevent the flow of air which moves along the duct from modifying the flow path of the atomised fuel as will be seen more clearly hereinbelow.

Figure 4:
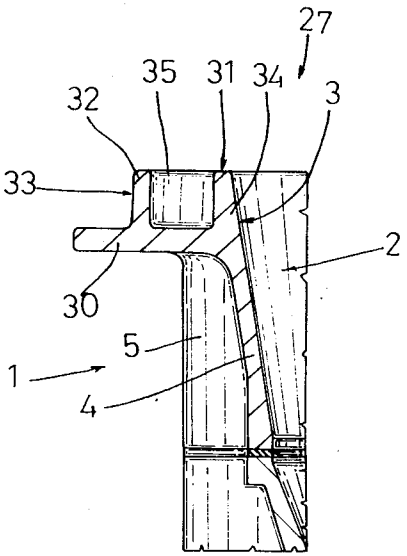
FIG. 4 is another detail of the device corresponding to a section taken on the line IV—IV of FIG. 1.

As is clearly seen in FIG. 4, an annular flange 30 projects radially from the wall 4 of the upper body 1, which flange is disposed below the edge 31 which delimits the top of the air induction opening 27; an annular projection 32 extends axially upwardly from the flange 30, the outer surface 33 of which projection has a diameter equal to that of the inner surface of the air filter, of annular form, which can be mounted on the device. Therefore the maximum diameter of the conical surface 3 which delimits the cavity 2 of the upper body 1 is less than the inner diameter of the air filter which, as has been mentioned, is substantially coincident with that of the outer surface 33 of the annular projection 32. Therefore between the projection 32 and the projection 34 (FIG. 4) which upwardly delimits the wall 4 of the body 1, there is defined a channel 35 of substantially annular form.

Within the said annular channel there are found the axes of vertical holes 36 formed in the upper body 1 and in the lower body 22 disposed in such a way as to be substantially coaxial, as is clearly seen in FIG. 2; the said holes can be traversed by the shanks of screws 37 which are able to connect the assembly constituted by the two bodies to an attachment plate 38 forming part of the induction manifold of the engine and on which the device is to be fixed; conveniently, the end parts of the said shanks are threaded and screwed into corresponding threaded holes of the plate itself.

Conveniently, studs 39 project axially from the upper body 1, the axes of which studs are disposed substantially within the annular channel 35 as is clearly seen in FIG. 1; the said studs are provided with threaded holes which can receive screws for fixing the air filter to the device.

The operation of the device of the invention is as follows.

During operation of the engine air is drawn into the induction opening 27 because of the vacuum which is caused within the interior of the duct defined by the conical surfaces 3 and 24 of the cavities 2 and 23 of the two upper and lower bodies 1 and 22 respectively. When the atomisation and metering valve 7 is activated fuel is delivered to the interior of this duct in the form of atomised particles which are disposed substantially within the spray cone defined by the generatrices 28. The flow of air is conveyed gradually through the annular channel defined between the conical surface 3 of the cavity 2 and the cylindrical surface 15 of the support element 6; subsequently this flow, by the combined action of the conical surface 16 of the support element itself, and the conical surface 24 of the body 22, is deviated and constrained to be directed towards the axis of the cavity 23 giving rise to a plurality of vortices some of which have been schematically indicated in FIG. 2. The presence of the annular cavity 17 also contributes to the formation of these vortices since within the interior of these there is established a pressure which is significantly greater than that which obtains within the cavity 23. The various air vortices thus generated interfere with the flow of fuel directed substantially along the spray cone 28 and mix intimately therewith: therefore, from the lower part of the cavity 23, immediately upstream of the fuel delivery outlet 25, a uniform mixture of air and fuel particles is present which moves towards the outlet itself. In this way the mixture of fuel and air is formed, which is significantly homogeneous because of the intimate mixing between the air and fuel caused by the said motion which depends on the form of the duct through which the air is constrained to pass.

Moreover, because of the presence of the annular projection 18 and of the maximum diameter which this projection has (coinciding substantially with that of the circumference of intersection of the outer surface of the spray cone 28 with the conical surface 24 of the cavity 23) the flow of atomised fuel which is sprayed from the valve 7 is not absolutely perturbed and therefore can substantially follow its path without being subject to significant deviation: this is favourable for obtaining a very homogeneous mixture and for preventing the flow of atomised fuel from being deviated with respect to the theoretical path and striking surfaces of the duct and, in particular, the butterfly 26 causing the formation of droplets on these surfaces. Such droplets, obviously, are the source of irregularities in operation of the engine. Therefore the annular projection 18 constitutes a deflector screen able to prevent the flow of air which comes from the first part of the duct, striking the flow of atomised fuel from causing it to deviate from the theoretically envisaged configuration.

The presence of the cavity 17 contributes therefore to the avoidance of the formation of fuel droplets as a result of the small fuel spray which is generated in correspondence with the phase of closure of the valve shutter member 7; as is known in some such phases fuel particles of very small dimensions can easily be generated, which move out from the spray cone 28 in a direction substantially orthogonal to that of the axis of the valve 7; during the path of such particles within the cavity 17 this kinetic energy is exhausted primarily because these strike the inner surfaces of the projection 18, with the consequence of avoiding the formation of small droplets which could give rise, upon falling on the butterfly 26 and through the delivery mouth 25, to irregular operation of the engine in particular when idling.

It has further been found that the conical surface 24 of the cavity 23 is favourable to the regularity of operation of the device; in fact, because of its rather large area which well exceeds that of a cylindrical surface having the same height and a diameter equal to the maximum diameter of the conical surface, it acts as a plenum chamber for the fuel particles which are delivered by the valve 7; these particles are therefore deposited on the surface during times when the valve is delivering, and are subsequently evaporated by the air flow which flows over these surfaces during times when the valve is not activated, therefore making the transfer between the fuel delivery phases and the phases of interruption of supply of fuel more gradual.

Because of the form of the duct for air and mixture the device of the invention has low pressure loss during operation: this is obviously a result of the shape of the duct, its symmetry and the arrangement of the ribs 13 which connects the support elements 6 for the valve 7 with the conical surface 3: as is seen from FIG. 1, because of the perfect symmetry of the ribs themselves, the air duct is perfectly symmetrical with respect to a plane which passes through the axis of the device and which contains the said ribs. Moreover, along the air and mixture ducts there are no obstacles or discontinuities which could alter the flow of air or mixture or which might generate high resistance to the passage thereof.

By the first mentioned said symmetry of the duct there is also obtained a uniformity of metering of the flow of the mixture to the various cylinders since the flow of mixture which leaves through the delivery outlet 25 is perfectly uniform in each point of the flow cross section of the opening itself. Similarly, there is an entirely uniform flow of air in correspondence with the air induction opening 27 consequent on the symmetry of the first mentioned duct, with the advantage of having an entirely regular operation of the device both in the presence and in the absence of an air filter.

It is evident that the device is very compact and of small dimensions because of the few parts with which it is made and because of the form of these. It can easily be fixed to the plate 38 of the manifold simply by means of the screws 37 and, because of the rather small dimensions, can be substituted on the plate itself for a conventional carburetor with which it is entirely interchangeable. Also, the air filter can easily be connected to the device by fitting this on the annular flange 30 (FIG. 4) and centering it on the cylindrical surface 33 of the annular projection 32; for the connection of the filter to the device it is sufficient to utilise screws which are screwed into the threaded holes of the studs 39.

It is apparent that the form and arrangement of the various parts of the device described can be modified and varied without departing from the scope of the invention.

We claim:

1. A device for the supply of a mixture of air and fuel to a manifold of an internal combustion engine, comprising an electromagnetically operated fuel atomisation and metering valve operable to deliver predetermined quantities of fuel in the form of atomised particles which move substantially within a spray cone, said valve being disposed along a duct which puts an air induction opening into communication with a mixture supply opening, the flow cross section of which is controlled by a butterfly valve, said device being fixable to an attachment plate of said manifold and being able to receive an air filter of annular form for filtering the air which enters said induction opening, characterized by the fact that it comprises an upper body in which is formed a first perforation in communication with said air induction opening and delimited by a first conical surface and a tubular valve-support element disposed within said first perforation, coaxial with said first conical surface and connected to the latter by means of a pair of ribs disposed substantially in a plane which contains the axis of said first conical surface, a lower body in which is formed a second perforation delimited by a second conical surface coaxial with said first conical surface and which is in communication with said mixture supply opening, the cone angle of said second conical surface being greater than the cone angle of said first conical surface.

2. A device according to claim 1, characterized by the fact that the axial length of said valve support element is substantially equal to the axial length of said first perforation, the outer surface of said valve support element defining with said first conical surface a passage section from said upper body to said lower body, the area of which is substantially greater than 50 percent of the area of said mixture supply opening.

3. A device according to claim 1, characterized by the fact that said valve support element is delimited externally by a first portion of a substantially cylindrical surface and by a second conical surface portion which is divergent towards said passage section from said upper to said lower body, the maximum diameter of said second conical surface being chosen to be substantially equal to the diameter of the circumference which is obtained by intersecting the conical surface which delimits said spray cone with said second conical surface of said second perforation of said lower body.

4. A device according to claim 1, characterized by the fact that said valve support element includes a cavity of substantially annular form formed within said second conical surface and disposed substantially about an atomised fuel injection nozzle of said valve.

5. A device according to claim 1, characterised by the fact that each of said ribs which connects said valve support element with said first conical surface has a substantially rectangular section and is joined at the top to a cylindrical surface.

6. A device according to claim 1, characterized by the fact that the maximum diameter of said first conical surface of said first perforation formed in said upper body is less than the diameter of said air filter.

7. A device according to claim 6, characterized in that said upper body includes a conical wall on which is formed said first conical surface, an annular flange for receiving said air filter, said flange being positioned beneath said air induction opening, projecting radially from said conical wall and being provided with an annular projection coaxial with said conical wall, between said annular projection and said conical wall there being defined a cavity of annular form.

8. A device according to claim 1, characterized by the fact that the length of said mixture supply opening is equal to or greater than the radius of the opening itself.

9. A device according to claim 1, characterized by the fact that said upper and lower bodies include coaxial through-holes which can be traversed by screws for fixing the device to said attachment plate.

10. A device according to claim 9, characterized by the fact that the axes of said through-holes are disposed in said annular cavity.

11. A device according to claim 7, characterized in that said upper body is provided with studs projecting from said annular cavity and provided with threaded holes for fixing said air filter.

* * * * *